US007365043B2

(12) United States Patent
Baker et al.

(10) Patent No.: US 7,365,043 B2
(45) **Date of Patent: *Apr. 29, 2008**

(54) LIPOPHILIC FLUID CLEANING COMPOSITIONS CAPABLE OF DELIVERING SCENT

(75) Inventors: Keith Homer Baker, Cincinnati, OH (US); Richard Timothy Hartshorn, Lawrenceburg, IN (US); Robert Richard Dykstra, Cleves, OH (US); William Michael Scheper, Guilford, IN (US); Mark Robert Sivik, Mason, OH (US); John Christian Haught, West Chester, OH (US)

(73) Assignee: The Procter & Gamble Co., Cincinnati, OH (US)

( * ) Notice: Subject to any disclaimer, the term of this patent is extended or adjusted under 35 U.S.C. 154(b) by 10 days.

This patent is subject to a terminal disclaimer.

(21) Appl. No.: 10/874,842

(22) Filed: Jun. 23, 2004

(65) Prior Publication Data

US 2005/0003980 A1 Jan. 6, 2005

Related U.S. Application Data

(60) Provisional application No. 60/483,359, filed on Jun. 27, 2003.

(51) Int. Cl.
*C11D 3/50* (2006.01)

(52) U.S. Cl. ..... 510/101; 510/285

(58) Field of Classification Search ..... 510/101, 510/475, 476, 285
See application file for complete search history.

(56) References Cited

U.S. PATENT DOCUMENTS

| | | | |
|---|---|---|---|
| 3,635,667 | A | 1/1972 | Keay et al. |
| 3,663,160 | A | 5/1972 | Stone et al. |
| 3,854,871 | A | 12/1974 | Eanzel et al. |
| 4,077,770 | A | 3/1978 | Rouvellat et al. |
| 4,097,397 | A | 6/1978 | Mizutani et al. |
| 4,102,824 | A | 7/1978 | Mizutani et al. |
| 4,111,034 | A | 9/1978 | Hubner |
| 4,137,044 | A | 1/1979 | Flower et al. |
| 4,207,072 | A | 6/1980 | Schuierer et al. |
| 4,267,077 | A | 5/1981 | Niimi et al. |
| 4,639,321 | A | 1/1987 | Barrat |
| 4,650,493 | A | 3/1987 | Pahisson et al. |
| 4,685,930 | A | 8/1987 | Kasprzak |
| 4,708,807 | A | 11/1987 | Kemerer |
| 4,761,896 | A | 8/1988 | Miyata |
| 4,909,962 | A | 3/1990 | Clark |
| 5,037,485 | A | 8/1991 | Chromecek et al. |
| 5,046,337 | A | 9/1991 | Ro et al. |
| 5,057,240 | A | 10/1991 | Madore et al. |
| 5,116,426 | A | 5/1992 | Asano et al. |
| 5,271,775 | A | 12/1993 | Asano et al. |
| 5,302,313 | A | 4/1994 | Asano et al. |
| 5,360,571 | A | 11/1994 | Kilgour et al. |
| 5,370,742 | A | 12/1994 | Mitchell et al. |
| 5,443,747 | A | 8/1995 | Inada et al. |
| 5,500,154 | A | 3/1996 | Bacon et al. |
| 5,503,681 | A | 4/1996 | Inada et al. |
| 5,503,778 | A | 4/1996 | Liu et al. |
| 5,520,827 | A | 5/1996 | Danner |
| 5,593,507 | A | 1/1997 | Inada et al. |
| 5,597,792 | A | 1/1997 | Klier et al. |
| 5,628,833 | A | 5/1997 | McCormack et al. |
| 5,676,705 | A | 10/1997 | Jureller et al. |
| 5,683,473 | A | 11/1997 | Jureller et al. |
| 5,683,977 | A | 11/1997 | Jureller et al. |
| 5,689,848 | A | 11/1997 | Saal et al. |
| 5,690,750 | A | 11/1997 | Inada et al. |
| 5,705,562 | A | 1/1998 | Hill |
| 5,707,613 | A | 1/1998 | Hill |
| 5,716,456 | A | 2/1998 | Inada et al. |
| 5,722,781 | A | 3/1998 | Yamaguchi |
| 5,741,365 | A | 4/1998 | Inada et al. |
| 5,769,962 | A | 6/1998 | Inada et al. |
| 5,783,092 | A | 7/1998 | Brown et al. |
| 5,784,905 | A | 7/1998 | Townsend et al. |
| 5,811,383 | A | 9/1998 | Klier et al. |
| 5,858,022 | A | 1/1999 | Romack et al. |
| 5,865,852 | A | 2/1999 | Berndt |
| 5,866,005 | A | 2/1999 | DeSimone et al. |
| 5,876,461 | A | 3/1999 | Racette et al. |
| 5,876,510 | A | 3/1999 | Kuemin et al. |

(Continued)

FOREIGN PATENT DOCUMENTS

| | | |
|---|---|---|
| CA | 1 239 326 | 7/1988 |

(Continued)

OTHER PUBLICATIONS

Trilo "Critical Micelle Density for the Self-Assembly of Block Copolymer Surfactantsin Supercritical Carbon Dioxide" pp. 416-421, 2000, no month available.

(Continued)

*Primary Examiner*—John R. Hardee
(74) *Attorney, Agent, or Firm*—Kim Wm. Zerby; Steven W. Miller

(57) ABSTRACT

The present invention relates to a composition and/or system comprising a perfume composition for use in a lipophilic fluid fabric treatment system and methods of making and using same. Such composition provides perfume/fabric substantivity.

2 Claims, No Drawings

U.S. PATENT DOCUMENTS

| | | | | |
|---|---|---|---|---|
| 5,877,133 | A | 3/1999 | Good | |
| 5,888,250 | A | 3/1999 | Hayday et al. | |
| 5,929,012 | A | 7/1999 | Del Duca et al. | |
| 5,942,007 | A | 8/1999 | Berndt et al. | |
| 5,944,996 | A | 8/1999 | DeSimone et al. | |
| 5,954,869 | A | 9/1999 | Elfersy et al. | |
| 5,977,040 | A | 11/1999 | Inada et al. | |
| 5,977,045 | A | 11/1999 | Murphy | |
| 5,985,810 | A | 11/1999 | Inada et al. | |
| 6,013,683 | A | 1/2000 | Hill et al. | |
| 6,042,617 | A | 3/2000 | Berndt | |
| 6,042,618 | A | 3/2000 | Berndt et al. | |
| 6,056,789 | A | 5/2000 | Berndt et al. | |
| 6,059,845 | A | 5/2000 | Berndt et al. | |
| 6,060,546 | A | 5/2000 | Powell et al. | |
| 6,063,135 | A | 5/2000 | Berndt et al. | |
| 6,086,635 | A | 7/2000 | Berndt et al. | |
| 6,114,295 | A | 9/2000 | Murphy | |
| 6,131,421 | A | 10/2000 | Jureller et al. | |
| 6,136,766 | A | 10/2000 | Inada et al. | |
| 6,148,644 | A | 11/2000 | Jureller et al. | |
| 6,156,074 | A | 12/2000 | Hayday et al. | |
| 6,177,399 | B1 | 1/2001 | Mei et al. | |
| 6,200,352 | B1 | 3/2001 | Romack et al. | |
| 6,200,393 | B1 | 3/2001 | Romack et al. | |
| 6,200,943 | B1 | 3/2001 | Romack et al. | |
| 6,204,233 | B1 | 3/2001 | Smith et al. | |
| 6,228,826 | B1 | 5/2001 | De Young et al. | |
| 6,242,408 | B1 | 6/2001 | Elms et al. | |
| 6,243,911 | B1 | 6/2001 | Varner | |
| 6,258,130 | B1 | 7/2001 | Murphy et al. | |
| 6,273,919 | B1 | 8/2001 | Hayday | |
| 6,309,425 | B1 | 10/2001 | Murphy et al. | |
| 6,310,029 | B1 | 10/2001 | Kilgour et al. | |
| 6,312,476 | B1 | 11/2001 | Perry | |
| 6,313,079 | B1 | 11/2001 | Murphy | |
| 6,326,013 | B1 * | 12/2001 | Lemann et al. | 424/401 |
| 6,358,909 | B1 * | 3/2002 | Ochomogo et al. | 510/417 |
| 6,362,159 | B1 | 3/2002 | Aguadisch et al. | |
| 6,368,359 | B1 | 4/2002 | Perry et al. | |
| 6,521,580 | B2 | 2/2003 | Perry et al. | |
| 6,548,465 | B2 | 4/2003 | Perry et al. | |
| 6,673,764 | B2 | 1/2004 | Severns | |
| 6,828,292 | B2 | 12/2004 | Noyes et al. | |
| 6,840,963 | B2 | 1/2005 | Severns | |
| 6,869,599 | B2 * | 3/2005 | Tournilhac et al. | 424/64 |
| 2002/0004953 | A1 | 1/2002 | Perry et al. | |
| 2002/0013234 | A1 | 1/2002 | Severns et al. | |
| 2003/0119709 | A1 | 6/2003 | Scheper | |

FOREIGN PATENT DOCUMENTS

| | | | |
|---|---|---|---|
| CN | 1069064 | | 2/1993 |
| DE | 2108 991 | A1 | 8/1972 |
| DE | 3739711 | A | 6/1989 |
| DE | 4131589 | A1 | 4/1993 |
| DE | 296 00 628 | U1 | 6/1997 |
| DE | 198 10907 | A1 | 9/1999 |
| EP | 0 091 261 | A2 | 10/1983 |
| EP | 0 118 625 | A2 | 9/1984 |
| EP | 0410 068 | A1 | 1/1991 |
| EP | 0 422 787 | A2 | 4/1991 |
| EP | 0 566 240 | A1 | 10/1993 |
| EP | 0 679 754 | A2 | 11/1995 |
| EP | 0182583 | A2 | 5/1996 |
| EP | 0 716 870 | A1 | 6/1996 |
| EP | 0 479 146 | B1 | 12/1996 |
| EP | 0 767 267 | A1 | 4/1997 |
| EP | 0 962 519 | A1 | 12/1999 |
| EP | 982 023 | A2 | 3/2000 |
| EP | 1 041 189 | A1 | 10/2000 |
| EP | 1059 315 | A1 | 12/2000 |
| FR | 2 268 898 | A1 | 11/1975 |
| GB | 2 084 204 | A | 4/1982 |
| GB | 2 230 022 | A | 10/1990 |
| GB | 2 251 867 | A | 7/1992 |
| JP | 1098-798 | A2 | 4/1989 |
| JP | 1188-595 | A2 | 7/1989 |
| JP | 01 246478 | | 10/1989 |
| JP | 2166-198 | A | 6/1990 |
| JP | 2202-599 | A | 8/1990 |
| JP | 2222-496 | A2 | 9/1990 |
| JP | 3046-300 | A2 | 2/1991 |
| JP | 4311799 | A | 4/1992 |
| JP | 04323299 | A | 11/1992 |
| JP | 05051598 | A | 3/1993 |
| JP | 05239766 | A | 9/1993 |
| JP | 08073837 | A | 3/1996 |
| JP | 09143497 | A | 6/1997 |
| JP | 10-017891 | | 1/1998 |
| JP | 11-092784 | | 4/1999 |
| JP | 11-323381 | | 11/1999 |
| JP | 11-323383 | | 11/1999 |
| JP | 00144175 | A | 5/2000 |
| JP | 2000-192085 | A2 | 7/2000 |
| JP | 002900689 | A | 10/2000 |
| SU | 1705444 | | 1/1992 |
| WO | WO 96/30471 | A2 | 10/1996 |
| WO | WO 98/07405 | A1 | 2/1998 |
| WO | WO 98/16615 | A1 | 4/1998 |
| WO | WO 00/04221 | A1 | 1/2000 |
| WO | WO 00/04222 | A1 | 1/2000 |
| WO | WO 00/63340 | A1 | 10/2000 |
| WO | WO 01/06051 | A1 | 1/2001 |
| WO | WO 01/34613 | A1 | 5/2001 |
| WO | WO 03/04694 | A1 | 6/2003 |

OTHER PUBLICATIONS

Sarbu "Non-Fluorous Polymers with Very High Solubility in Supercritical Co2 Down to Low Pressuress" pp. 165-168, May 2000.

International Search Report, Jul. 2005.

* cited by examiner

LIPOPHILIC FLUID CLEANING COMPOSITIONS CAPABLE OF DELIVERING SCENT

CROSS-REFERENCES TO RELATED APPLICATIONS

This application claims priority under 35 U.S.C. §119(e) to U.S. Provisional Application Ser. No. 60/483,359 filed Jun. 27, 2003.

FIELD OF THE INVENTION

The present invention relates to fabric care and cleaning compositions comprising a perfume, methods for using such compositions and systems for their use in a lipophilic fluid treatment process. More particularly, the present invention relates to fabric care and cleaning compositions and systems comprising a perfume, and methods for using such compositions in the cleaning and treatment of garments with a lipophilic fluid.

BACKGROUND OF THE INVENTION

It has been discovered that simplification of the automatic home laundry process and elimination of the reliance on a solely water based home laundry process are possible by using a lipophilic fluid-based wash medium for the home laundry process. This process allows not only the home cleaning of a consumer's "dry clean only" fabric articles, but also those "machine wash" articles conventionally washed at home in a water wash medium. Further while the consumer may still opt to wash such articles separately, the present invention process allows the consumer the freedom to significantly simplify the home laundry process by washing mixed loads of "dry clean only" and "machine wash" articles, thereby greatly reducing the presorting effort.

Consumers expect that freshly cleaned fabrics will have a fresh pleasing scent. Unfortunately, lipophilic fluids usually contain significant levels of offensive odor contaminants. Thus, lipophilic fluid-based wash mediums typically have an undesirable odor that may be imparted to an item that is contacted with such medium. While the addition of perfume to a lipophilic wash medium may minimize the odor of the wash medium, such perfumes do not provide the desired fabric substantivity.

Accordingly, there is a need for fabric care compositions and systems that comprise a perfume composition that provides the desired fabric substantivity and methods of making and using same.

SUMMARY OF THE INVENTION

The present invention relates to a composition and/or system comprising a perfume composition for use in a lipophilic fluid fabric treatment system and methods of making and using same.

DETAILED DESCRIPTION OF THE INVENTION

Definitions

The term "fabrics" and "fabric" used herein is intended to mean any article that is customarily cleaned in a conventional laundry process or in a dry cleaning process. As such the term encompasses articles of clothing, linen, drapery, and clothing accessories. The term also encompasses other items made in whole or in part of fabric, such as tote bags, furniture covers, tarpaulins and the like.

The term "soil" means any undesirable substance on a fabric. By the terms "water-based" or "hydrophilic" soils, it is meant that the soil comprised water at the time it first came in contact with the fabric article, or the soil retains a significant portion of water on the fabric article. Examples of water-based soils include, but are not limited to beverages, many food soils, water soluble dyes, bodily fluids such as sweat, urine or blood, outdoor soils such as grass stains and mud.

As used herein, the articles a and an when used in a claim, for example, "an emulsifier" or "a perfume delivery system" is understood to mean one or more of the material that is claimed or described.

Unless otherwise noted, all component or composition levels are in reference to the active level of that component or composition, and are exclusive of impurities, for example, residual solvents or by-products, which may be present in commercially available sources.

All percentages, ratios and proportions herein are by weight, unless otherwise specified. All temperatures are in degrees Celsius (° C.) unless otherwise specified. All measurements are in SI units unless otherwise specified. All documents cited are in relevant part, incorporated herein by reference.

Fabric Care and Cleaning Composition

The fabric care and cleaning compositions of the present invention comprises a perfume delivery composition selected from the group consisting of starch encapsulated accord, perfume loaded zeolite, perfume loaded cyclodextrin, amine reaction product, amine assisted delivery system, polymeric micro latex system, perfume containing micro capsules, cellulose binding systems and mixtures thereof, and a lipophilic fluid with any balance being adjunct materials. The lipophilic fluid cleaning compositions of the present invention typically comprise, by weight of the composition, from about 0.001%, from about 0.001% to about 10%, from about 0.01% to about 5%, or even from about 0.1% to about 2% of a delivery composition selected from the group consisting of starch encapsulated accord, perfume loaded zeolite, perfume loaded cyclodextrin, amine reaction product, amine assisted delivery system, polymeric micro latex system, perfume containing micro capsules, cellulose binding systems and mixtures thereof.

Kit For Making Fabric Care and Cleaning Compositions

The fabric care and cleaning compositions of the present invention may be made using a kit comprising a perfume delivery composition selected from the group consisting of starch encapsulated accords, perfume loaded zeolite, perfume loaded cyclodextrin, amine reaction product, amine assisted delivery system, polymeric micro latex system, perfume containing micro capsules, cellulose binding systems and mixtures thereof, and instructions for use. Such instructions typically describe the process of making the fabric care and cleaning compositions of the present invention using said kit. Said kit typically comprises a composition that comprises, by weight of said composition, from about 0.01% to about 100%, from about 0.01% to about 50%, or even from about 0.01% to about 10% of a delivery composition selected from the group consisting of starch encapsulated accord, perfume loaded zeolite, perfume loaded cyclodextrin, amine reaction product, amine assisted delivery system, polymeric micro latex system, perfume containing micro capsules, cellulose binding systems and mixtures thereof with any balance of said composition being adjunct ingredients.

Process of Making

Applicants' compositions may be made by combining a perfume delivery system selected from the group consisting of starch encapsulated accord, perfume loaded zeolite, perfume loaded cyclodextrin, amine reaction product, amine assisted delivery system, polymeric micro latex system, perfume containing micro capsules, cellulose binding systems and mixtures thereof with a lipophilic fluid in any conventional manner. Depending on the desired composition, the process of combining may require agitation or mixing. Such compositions may also be made by combining the composition of the aforementioned kit with a lipophilic fluid.

Method of Use

A scent may be delivered to an item, including but not limited to a fabric, by contacting said item with a lipophilic fluid cleaning composition taught herein. As will be appreciated by the skilled artisan, contacting includes but is not limited to, immersion and spraying.

Materials

Starch Encapsulated Accords can be made by following the teachings of this specification and the examples contained herein or those of U.S. Pat. No. 6,458,754. Starches suitable for encapsulating the perfume oils of the present invention can be made from, raw starch, pre-gelatinized starch, modified starch derived from tubers, legumes, cereal and grains, for example corn starch, wheat starch, rice starch, waxy corn starch, oat starch, cassava starch, waxy barley, waxy rice starch, sweet rice starch, amioca, potato starch, tapioca starch, oat starch, cassava starch, and mixtures thereof. Modified starches suitable for use as the encapsulating matrix in the present invention include, hydrolyzed starch, acid thinned starch, starch esters of long chain hydrocarbons, starch acetates, starch octenyl succinate, and mixtures thereof. The term "hydrolyzed starch" refers to oligosaccharide-type materials that are typically obtained by acid and/or enzymatic hydrolysis of starches, preferably corn starch. Suitable hydrolyzed starches for inclusion in the present invention include maltodextrins and corn syrup solids. The hydrolyzed starches for inclusion with the mixture of starch esters have a Dextrose Equivalent (DE) values of from about 10 to about 36 DE. The DE value is a measure of the reducing equivalence of the hydrolyzed starch referenced to dextrose and expressed as a percent (on a dry basis). The higher the DE value, the more reducing sugars present. A method for determining DE values can be found in Standard Analytical Methods of the Member Companies of Corn Industries Research Foundation, 6th ed. Corn Refineries Association, Inc. Washington, D.C. 1980, D-52. Starch esters having a degree of substitution in the range of from about 0.01% to about 10.0% may be used to encapsulate the perfume oils of the present invention. The hydrocarbon part of the modifying ester should be from a $C_5$ to $C_{16}$ carbon chain. Preferably, octenylsuccinate (OSAN) substituted waxy corn starches of various types such as 1) waxy starch: acid thinned and OSAN substituted,
2) blend of corn syrup solids: waxy starch, OSAN substituted, and dextrinized,
3) waxy starch: OSAN substituted and dextrinized,
4) blend of corn syrup solids or maltodextrins with waxy starch: acid thinned OSAN substituted, and then cooked and spray dried,
5) waxy starch: acid thinned and OSAN substituted then cooked and spray dried, and
6) the high and low viscosities of the above modifications (based on the level of acid treatment) can also be used in the present invention.

Another example of useful a polysaccharide material that can be used is methylcellulose, which is disclosed in DE19942581.

Perfume containing zeolites as well as perfume containing coated zeolites can be made by following the teachings of this specification and the examples contained herein or those of U.S. Pat. No. 5,858,959. Suitable coating materials include at least partially water soluble hydroxylic compounds. Suitable zeolites include zeolites X, Y and mixtures thereof. Aluminosilicate zeolites are particularly useful. Other suitable silicate containing are disclosed in EP-816484 and WO 00/12669.

Perfume loaded cyclodextrins can be made by following the teachings of this specification or those of U.S. Pat. No. 5,552,378. Typically, the complexes are formed either by bringing the perfume and the cyclodextrin together in a suitable solvent, e.g., water, or, preferably, by kneading the ingredients together in the presence of a suitable, preferably minimal, amount of sol-vent, preferably water. The kneading method is particularly desirable because it results in smaller particles so that there is less, or no, need to reduce the particle size and less solvent is needed and therefore less separation of the solvent is required. Suitable processes are disclosed in the patents incorporated hereinbefore by reference. Additional disclosures of complex formation can be found in Atwood, J. L., J. E. D. Davies & D. D. MacNichol, (Ed.): Inclusion Compounds, Vol. III , Academic Press (1984), especially Chapter 11, and Atwood, J. L. and J. E. D. Davies (Ed.): Proceedings of the Second International Symposium of Cyclodextrins Tokyo, Japan, (July 1984),both of said publications being incorporated by reference. In general, active/cyclodextrin complexes have a molar ratio of active compound to cyclodextrin of 1:1. How-ever, the molar ratio can be either higher or lower, de-pending on the size of the active compound and the identity of the cyclodextrin compound. The molar ratio can be determined easily by forming a saturated solution of the cyclodextrin and adding the active to form the complex. In general the complex will precipitate readily. If not, the complex can usually be precipitated by the addition of electrolyte, change of pH, cooling, etc. The complex can then be analyzed to determine the ratio of active to cyclodextrin. As stated hereinbefore, the actual complexes are determined by the size of the cavity in the cyclodextrin and the size of the active molecule. Although the normal complex is one molecule of active in one molecule of cyclodextrin, complexes can be formed between one molecule of active and two molecules of cyclodextrin when the active molecule is large and contains two portions that can fit in the cyclodextrin. Highly desirable complexes can be formed using mixtures of cyclodextrins since some actives like perfumes and flavor extracts are normally mixtures of materials that vary widely in size. It is usually desirable that at least a majority of the material be alpha-, beta-, and/or gamma-cyclodextrin, more preferably beta-cyclodextrin. Processes for the production of cyclodextrins and complexes are described in U.S. Pat. No. 3,812,011, Okada, Tsuyama, and Tsuyama, issued May 21, 1974; U.S. Pat. No. 4,317,881,Yagi, Kouno and Inui, issued Mar. 2, 1982; U.S. Pat. No. 4,418,144,Okada, Matsuzawa, Uezima, Nakakuki, and Horikoshi, is-sued Nov. 29, 1983; U.S. Pat. No. 4,378,923, Ammeraal, issued Apr. 19, 1988. Materials obtained by any of these variations are acceptable for the purposes of this invention. It is also acceptable to initially isolate the inclusion complexes directly from the reaction mixture by crystallization. Continuous operation usually involves the use of supersaturated solutions, and/or kneading, and/or temperature manipulation, e.g., heating and then either cooling, freeze-drying, etc. The complexes may be dried or not depending on the next step in the process for making the de-sired composition. In general, the fewest possible process steps are used to avoid loss of active.

The particle sizes of the complexes herein are selected to improve the release, and especially the speed of release, of the active. The small particles of this invention, e.g., those having a particle size of less than about 12 microns, preferably less than about 10 microns, more preferably less than about 8 microns, and even more preferably less than about 5 microns, are desirable for providing a quick release of the active when the complexes are wetted. The particle size range is typically between about 0.001 and 10 microns, preferably between about 0.05and 5 microns. It is highly desirable that at least an effective amount of the active be in complexes having the said particle sizes. It is desirable that at least about 75%,preferably at least about 80% and more preferably at least about 90% of the complex that is present have the said particle sizes. It is even better if essentially all of the complex has the said particle sizes. These small particles of the invention are conveniently prepared by kneading methods and/or grinding techniques. Cyclodextrin complexes with large particle sizes can be pulverized to obtain the desired smaller particles of about 10 microns and less by using, e.g., a fluid energy mill. Examples of fluid energy mills are the TrostAir Impact Pulverizers, sold by Garlock Inc., Plastomer Products, Newtown, Pa.; the Micronizer fluid energy mills sold by Sturtevant, Inc., Boston, Mass.; and the Spiral Jet Mill sold by Alpine Division, MicroPul Corporation (Hosokawa Micron International, Inc., Summit, N.J. As used herein, the particle size refers to the largest dimension of the particle and to the ultimate (or primary)particles. The size of these primary particles can be directly determined with optical or scanning electron microscopes. The slides must be carefully prepared so that each contains a representative sample of the bulk cyclodextrin complexes. The particles sizes can also be measured by any of the other well-known methods, e.g., wet sieving, sedimentation, light scattering, etc. A convenient instrument that can be used to determine the particle size distribution of the dry complex powder directly (without having to make a liquid suspension or dispersion) is the Malvern Particle and Droplet Sizer, Model2600C, sold by Malvern Instruments, Inc., Southborough, Mass. Some caution should be observed in that some of the dry particles may remain agglomerated. The presence of agglomerates can be further determined by microscopic analysis. Some other suitable methods for particle size analysis are described in the article "Selecting a particle size analyzer: Factors to consider," by Michael Pohl, published in Powder and Bulk Engineering, Volume 4 (1990), pp. 26-29, incorporated herein by reference. It is recognized that the very small particles of the invention can readily aggregate to form loose agglomerates that are easily broken apart by either some mechanical action or by the action of water. Accordingly, particles should be measured after they are broken apart, e.g., by agitation or sonication. The method, of course, should be selected to accommodate the particle size and maintain the integrity of the complex particles, with iterative measurements being made if the original method selected proves to be inappropriate. The amount of coating applied to the particles is about 3% by weight of the total coated particle weight. When the coating is completed, the softener particles are resized through 11 on 26 mesh U.S. Standard screens and are then ready for use "as is" or for blending into lipophilic fluids.

Amine reaction products can be made by following the teachings of this specification and examples contained herein or those of U.S. Pat. No. 6,413,920. Suitable perfume aldehyde/ketones for making reaction products include materials selected from the group consisting of 1-decanal, benzaldehyde, florhydral, 2,4dimethyl-3-cyclohexen-1-carboxaldehyde; cis/trans-3,7-dimethyl-2,6octadien-1-al; heliotropin;2,4,6-trimethy]-3-cyclohexene-1-carboxaldehyde; 2,6-nonadienal; alpha-n-amyl cinnamic aldehyde, alpha-n-hexyl cinnamic aldehyde, P. T. Bucinal, lyral, cymal, methyl nonyl acetaldehyde, hexanal, trans-2-hexenal, Alpha Damascone, Delta Damascone, Iso Damascone, Carvone, Gamma-Methyl-lonone, Iso-E-Super,2,4,4,7Tetramethyl-oct-6-en-3-one, Benzyl Acetone, Beta Damascone, Damascenone, methyl dihydrojasmonate, methyl cedrylone, and mixtures thereof. Suitable amino-functional materials include amino functional materials comprising at least one primary and/or secondary amine group having Odour Intensity Index of less than that of a 1% solution of methylanthranitrilate in dipropylene glycol determined according to the Odour Intensity Index found in the Test Methods Section of this specification.

Amine assisted delivery systems may be made by following the teaching and examples of this specification. Amine assisted delivery systems comprise an amine cfompound and a benefit agent. It is an essential feature of the present invention that the amine compound and the benefit agent be added separately to the lipophilic fluid. For purposes of this invention, the amine-based compound and benefit agent are separately added to the system-forming matrix if the entire amounts of these components are combined with the matrix as discrete components. In particular, there must be essentially no chemical reaction between these two materials before they are combined with the matrix. Thus the amine compound and the benefit agent may be added to the matrix at separate times and/or from separate containers or from separate holding or delivery means. Suitable amine-based compounds include mono-amine or a polyamine so long as its weight average molecular weight is greater than 100 Daltons and so long as at least 10% of its amino groups are primary amino groups. Preferably the amino-based compound will be a polyamine, the molecular weight of the compound will be at least 150 Daltons, and from 15% to 80% of its amino groups will be primary amino groups. The amine-based compounds used in this invention are also may be ones characterized by having an Odor Intensity Index of less than that of a 1% solution of methylanthranilate in dipropylene glycol.

A wide variety of primary amine-based compounds which have the preferred Odor Intensity Index characteristics can be used to prepare the benefit agent delivery systems of this invention. A general structure for a primary amine compound useful in this invention is as follows:

$$B—(NH_2)_n;$$

wherein B is a carrier material, and n is an index of value of at least 1. Compounds containing a secondary amine group have a structure similar to the above with the exception that the compound comprises one or more —NH— groups as well as —$NH_2$ groups. Preferably the amine compounds of this general type will be relatively viscous materials. Suitable B carriers include both inorganic and organic carrier moieties. By "inorganic carrier", it is meant a carrier that is comprised of non- or substantially non-carbon based backbones. Preferred primary amines, utilizing inorganic carriers, are those selected from mono or polymers or organic-organosilicon copolymers of amino derivatised organo silane, siloxane, silazane, alumane, aluminum siloxane, or aluminum silicate compounds. Typical examples of such carriers are: organosiloxanes with at least one primary amine moiety like the diaminoalkylsiloxane $[H_2NCH_2(CH_3)_2Si]O$, or the organoaminosilane $(C_6H_5)3SiNH_2$ described in: Chemistry and Technology of Silicone, W. Noll, Academic Press Inc. 1998, London, pp 209, 106). Preferred primary amines, utilizing organic carriers, are those selected from aminoaryl derivatives, polyamines, amino acids and derivatives thereof, substituted amines and amides, glucamines, dendrimers, polyvinylamines and derivatives thereof, and/or copolymer thereof, alkylene polyamine, polyaminoacid and copolymer thereof, cross-linked polyaminoacids, amino substituted polyvinylalcohol, polyoxyethylene bis amine or bis aminoalkyl, amioalkyl piperazine and derivatives thereof, bis (amino alkyl) alkyl diamine linear or branched, and mixtures thereof.

Preferred aminoaryl derivatives are the amino-benzene derivatives including the alkyl esters of 4-amino benzoate compounds, and more preferably selected from ethyl-4-amino benzoate, phenylethyl-4-aminobenzoate, phenyl-4-aminobenzoate,4-amino-N'-(3-aminopropyl)-benzamide, and mixtures thereof.

Polyamines suitable for use in the present invention are polyethyleneimine polymers, partially alkylated polyethylene polymers, polyethyleneimine polymers with hydroxyl groups, 1,5-pentanediamine, 1,6-hexanediamine, 1,3pentanediamine, 3-dimethylpropanediamine, 1,2-cyclohexanediamine, 1,3-bis(aminomethyl)cyclohexane, tripropylenetetraamine, bis(3-aminopropyl)piperazine, dipropylenetriamine, tris(2-aminoethylamine), tetraethylenepentamine, bishexamethylenetriamine, bis(3-aminopropyl)1,6-hexamethylenediamine, 3,3'-diamino-N-methyldipropylamine, 2-methyl-1,5-pentanediamine, N,N,N',N'-tetra(2-aminoethyl)ethlenediamine, N,N,N',N'-tetra(3-aminopropyl)-1,4-butanediamine, pentaethylhexamine, 1,3-diamino-2-propyl-tert-butylether, isophorondiamine, 4,4',-diaminodicyclohymethane, N-methyl-N-(3-aminopropyl) ethanolamine, spermine, spermidine, 1-piperazineethaneamine, 2-(bis(2-aminoethyl)amino)ethanol, ethoxylated N-(tallowalkyl)trimethylene diamines,poly[oxy(methyl-1,2-ethanediyl)], α-(2-aminomethylethoxy)-(=C.A.S No.9046-10-0); poly[oxy(methyl-1,2-ethanediyl)], α-hydro-)-ω-(2-aminomethylethoxy)-, ether with 2-ethyl-2-(hydroxymethyl)-1,3-propanediol (=C.A.S. No. 39423-51-3); commercially available under the tradename Jeffamines T-403, D-230, D-400, D-2000; 2,2',2"-triaminotriethylamine; 2,2'-diamino-diethylamine; 3,3'-diamino-dipropylamine, 1,3 bis aminoethyl-cyclohexane commercially available from Mitsubishi and the C12 Stemamines commercially available from Clariant like the C12 Sternamin(propylenamine)$_n$ with n=¾, and mixtures thereof. Preferred polyamines are polyethyleneimines commercially available under the tradename Lupasol like Lupasol FG (MW 800), G20wfv (MW 1300), PR8515(MW 2000), WF (MW 25000), FC (MW 800), G20 (MW 1300), G35 (MW 1200), G100 (MW 2000), HF (MW 25000), P (MW 750000), PS (MW 750000), SK (MW 2000000), SNA (MW 1000000). Of these, the most preferred include Lupasol HF or WF (MW 25000), P (MW 750000), PS (MW 750000), SK (MW 2000000), 620wfv (MW 1300) and PR 1815 (MW 2000), Epomin SP-103, Epomin SP-110, Epomin SP-003, Epomin SP-006, Epomin SP-012, Epomin SP-018, Epomin SP-200, and partially alkoxylated polyethyleneimine, like polyethyleneimine 80% ethoxylated from Aldrich.

The benefit agents essentially used to form the delivery systems of this invention must be in the form of a perfume ketone or aldehyde and mixtures thereof. Perfume ketones utilized in the benefit agent delivery systems herein can comprise any material which is chemically a ketone and which can impart a desirable odor or freshness benefit to surfaces which have been contacted with the delivery systems formed from it. The perfume ketone component can, of course, comprise more than one ketone, i.e., mixtures of ketones. Preferably, the perfume ketone is selected from buccoxime; iso jasmone; methyl beta naphthyl ketone; musk indanone; tonalid/musk plus; Alpha-Damascone, Beta-Damascone, Delta-Damascone, Iso-Damascone, Damascenone, Damarose, Methyl-Dihydrojasmonate, Menthone, Carvone, Camphor, Fenchone, Alpha-Ionone, Beta-Ionone, dihydro-Beta-Ionone, Gamma-Methyl so-called Ionone, Fleuramone, Dihydrojasmone, Cis-Jasmone, Iso-E-Super, Methyl-Cedrenyl-ketone or Methyl- Cedrylone, Acetophenone, Methyl-Acetophenone, Para-Methoxy-Acetophenone, Methyl-Beta-Naphtyl-Ketone, Benzyl-Acetone, Benzophenone, Para-Hydroxy-Phenyl-Butanone, Celery Ketone or Livescone, 6-Isopropyldecahydro-2-naphtone, Dimethyl-Octenone, Freskomenthe, 4-(1-Ethoxyvinyl)-3,3,5,5,-tetramethyl-Cyclohexanone, Methyl-Heptenone, 2-(2-(4-Methyl-3-cyclohexen-1-yl)propyl)-cyclopentanone, 1-(p-Menthen-6(2)-yl)-1-propanone, 4-(4-Hydroxy-3-methoxyphenyl)-2-butanone, 2-Acetyl-3,3-Dimethyl-Norbornane, 6,7-Dihydro-1,1,2,3,3-Pentamethyl-4(5H)-Indanone, 4-Damascol, Dulcinyl or Cassione, Gelsone, Hexalon, Isocyclemone E, Methyl Cyclocitrone, Methyl-Lavender-Ketone, Orivon, Para-tertiary-Butyl-Cyclohexanone, Verdone, Delphone, Muscone, Neobutenone, Plicatone, Veloutone, 2,4,4,7-Tetramethyl-oct-6-en-3-one, Tetrameran, hedione, floralozone, and mixtures thereof.

Perfume aldehydes useful as benefit agents herein can comprise any perfume material which is chemically an aldehyde, which can, like the perfume ketone component, also impart a desirable odor or freshness benefit to surfaces which have been contacted with the delivery systems formed from it. As with the perfume ketone benefit agents, the perfume aldehyde benefit agent component can comprise a single individual aldehyde or mixtures of two or more perfume aldehydes. In addition, the perfume aldehyde materials useful herein will preferably comprise aldehydes that are relatively "bulky." By bulky, it is meant that the perfume aldehyde will have relatively high molecular weight and have a relatively high boiling point. For purposes of this invention, high molecular weight perfume aldehydes are those having a boiling point greater than 225° C. Further, for purposes of this invention, high molecular weight perfume aldehydes are those with a weight average molecular weight greater than 150. Suitable perfume aldehyde materials for use in the delivery systems herein, whether by themselves or as part of a perfume aldehyde mixture, include adoxal; anisic aldehyde; cymal; ethyl vanillin; florhydral; helional; heliotropin; hydroxycitronellal; koavone; lauric aldehyde; lyral; triplal, melonal, methyl nonyl acetaldehyde; P. T. bucinal; phenyl acetaldehyde; undecylenic aldehyde; vanillin; 2,6,10-trimethy-9-undecenal, 3-dodecen-1-al, alpha-n-amyl cinnamic aldehyde, 4-methoxybenzaldehyde, benzaldehyde, 3-(4-tert butylphenyl)-propanal, 2-methyl-3-(para-methoxyphenyl propanal, 2-methyl-4-(2,6,6-trimethyl-2(1)-cyclohexen-1-yl) butanal, 3-phenyl-2-propenal, cis-/trans-3,7-dimethyl-2,6-octadien-1-al, 3,7-dimethyl-6-octen-1-al, [(3,7-dimethoctenyl)oxy]acetaldehyde, 4-isopropylbenzyaldehyde, 1,2,3,4,5,6,7,8-octahydro-8,8-dimethyl-2-naphthaldehyde, 2,4-dimethyl-3-cyclohexen-1-carboxaldehyde, 2-methyl-3-(isopropylphenyl)propanal, 1-decanal; decyl aldehyde, 2,6-dimethyl-5-heptenal, 4-(tricyclo[5.2.1.0(2,6)]-decylidene-8)-butanal, octahydro-4,7-methano-1H-indenecarboxaldehyde, 3-ethoxy-4-hydroxy benzaldehyde, para-ethyl-alpha, alpha-dimethyl hydrocinnamaldehyde, alpha-methyl-3,4-(methylenedioxy)-hydrocinnamaldehyde, 3,4-methylenedioxybenzaldehyde, alpha-n-hexyl cinnamic aldehyde, m-cymene-7-carboxaldehyde, alpha-methyl phenyl acetaldehyde, 7-hydroxy-3,7-dimethyl octanal, Undecenal, 2,4,6-trimethyl-3-cyclohexene-1-carboxaldehyde, 4-(3)(4-methyl-3-pentenyl)-3-cyclohexen-carboxaldehyde, 1-dodecanal, 2,4-dimethyl cyclohexene-3-carboxaldehyde, 4-(4-hydroxy4-methyl pentyl)-3-cylohexene-1-carboxaldehyde, 7-methoxy-3,7-dimethyloctan-1-al, 2-methyl undecanal, 2-methyl decanal, 1-nonanal, 1-octanal, 2,6,10-trimethyl-5,9-undecadienal, 2-methyl-3-(4-tertbutyl)propanal, dihydrocinnamic aldehyde, 1-methyl4-(4-methyl-3-pentenyl)-3-cyclohexene-1-carboxaldehyde,5 or 6 methoxy0hexahydro-4,7-methanoindan-1or 2-carboxaldehyde, 3,7-dimethyloctan-1-al, 1-undecanal, 10-undecen-1-al, 4-hydroxy-3-methoxy benzaldehyde, 1-methyl-3-(4-methylpentyl)-3-cyclhexenecarboxaldehyde, 7-hydroxy-3,7-dimethyl-octanal, trans-4-decenal, 2,6-nonadienal, para-tolylacetaldehyde; 4-methylphenylacetaldehyde, 2-methyl4-(2,6,6-trimethyl-1-cyclohexen-1-yl)-2-butenal, ortho-methoxycinnamic aldehyde, 3,5,6-trimethyl-3-cyclohexene carboxaldehyde, 3,7-dimethyl-2-methylene-6-octenal, phenoxyacetaldehyde, 5,9-dimethyl-4,8-decadienal, peony aldehyde (6,10-dimethyl-3-oxa-5,9-undecadien-1-al), hexahydro-4,7-methanoindan-1-carboxaldehyde 2-methyl octanal, alpha-methyl-4-(1-methyl ethyl)benzene acetaldehyde, 6,6-dimethyl-2-norpinene-2-propionaldehyde, para methyl phenoxy acetaldehyde, 2-methyl-3-phenyl-2-propen-1-al, 3,5,5-trimethyl hexanal, Hexahydro-8,8-dimethyl-2-naphthaldehyde, 3-propyl-bicyclo[2.2.1]-hept-5-ene-2-carbaldehyde, 9-decenal, 3-methyl-5-phenyl-1-pentanal, methylnonyl acetaldehyde, 1-p-menthene-q-carboxaldehyde, citral, lilial, cumin aldehyde, mandarin aldehyde, Datilat, geranial, and mixtures thereof.

The benefit agent delivery system suitable for use in granular forms/matrices can be prepared by simply admixing the amine-based compound and the benefit agent ketone and/or aldehyde with the matrix under conditions which are sufficient to bring about combination, e.g., thorough admixture, of these components with the liquid or granular matrix. Frequently this admixing is carried out using high shear agitation. Temperatures of from 40° C. to 65° C. may be utilized. Additional materials may also be added to the matrix in order to form the complete end product into which the delivery system is to be incorporated.

Polymeric particles such as polymeric micro latex system, and perfume containing micro capsules can be made by following the teachings of this specification and the examples. The polymeric particle of the present invention is polymerized from at least one cationic monomer and one or more non-cationic monomers, preferably also a cross-linking monomer. The polymerization process may be any suitable process known in the art, such as emulsion and/or suspension and/or miniemulsion polymerization. During the polymerization, an emulsifier and/or stabilizer may be present to keep the polymeric particles from coagulating and/or crashing out of the aqueous solution in which the polymeric particles are being formed.

The monomers of the polymeric particle may be selected such that the resulting polymeric particle has an affinity for perfume raw materials having a molecular weight of less than about 200, a boiling point of less than about 250° C. and a ClogP of less than about 3 and/or a Kovats Index value of less than about 1700.

The polymeric particle can be derived from about 50% to about 99.9% and/or from about 60% to about 95% by weight of non-cationic monomers, from about 0.1% to about 50% and/or from about 1% to about 10% by weight of cationic monomers and from about 0% to about 25% and/or from about 1% to about 10% by weight of cross-linking monomers.

The monomers polymerized to form the polymeric particle may be used in a weight ratio of non-cationic monomer: cationic monomer:cross-linking monomer of from about 10:0.02:0 to about 5:2.5:1.

In addition, it is desirable that the polymeric particle is stable within product formulations, such as perfume compositions, especially fabric softener compositions in accordance with the present invention.

To aid in the stabilizing the polymeric particle in aqueous dispersions and/or in product formulations, such as perfume compositions, a stabilizer, also known as a colloidal stabilizer may be added to the aqueous dispersion and/or product formulation. It is desirable that the colloidal stabilizer be compatible with other ingredients within the aqueous dispersion and/or product formulation.

Other examples may be found in WO 00/68352, DE 10000223, WO 200162376 A, WO 200234227 A, EP-A-908,174, DE 10100689 A, WO 200285420 A, U.S. Pat. No. 3,516,846, U.S. Pat. No. 3,516,942, U.S. Pat. No. 4,100,103, U.S Pat. No. 4,520,142, WO 95/19707, EP 593809, WO 03/002699 U.S. Pat. No. 4,464,271, U.S. Pat. No. 4,145,184, U.S. Pat. No. 5,137,646, U.S. Pat. No. 3,870,542, U.S. Pat. No. 3,415,758, U.S. Pat. No. 4,145,184, U.S. Pat. No. 4,806,345.

Cellulose binding systems include systems wherein perfume molecules are attached to cellulose binding polysaccharides and then carried to cellulosic surfaces as described in WO 99/36469.

As used herein, "lipophilic fluid" means any liquid or mixture of liquid that is immiscible with water at up to 20% by weight of water. In general, a suitable lipophilic fluid can be fully liquid at ambient temperature and pressure, can be an easily melted solid, e.g., one which becomes liquid at temperatures in the range from about 0° C. to about 60° C., or can comprise a mixture of liquid and vapor phases at ambient temperatures and pressures, e.g., at 25° C. and 1 atm. of pressure.

It is preferred that the lipophilic fluid herein be inflammable or, have relatively high flash points and/or low VOC characteristics, these terms having conventional meanings as used in the dry cleaning industry, to equal or, preferably, exceed the characteristics of known conventional dry cleaning fluids.

Non-limiting examples of suitable lipophilic fluid materials include siloxanes, other silicones, hydrocarbons, glycol ethers, glycerine derivatives such as glycerine ethers, perfluorinated amines, perfluorinated and hydrofluoroether solvents, low-volatility nonfluorinated organic solvents, diol solvents, other environmentally-friendly solvents and mixtures thereof.

"Siloxane" as used herein means silicone fluids that are non-polar and insoluble in water or lower alcohols. Linear siloxanes (see for example U.S. Pat. Nos. 5,443,747, and 5,977,040) and cyclic siloxanes are useful herein, including the cyclic siloxanes selected from the group consisting of octamethyl-cyclotetrasiloxane (tetramer), dodecamethyl-cyclohexasiloxane (hexamer), and preferably decamethyl-cyclopentasiloxane (pentamer, commonly referred to as "D5"). A preferred siloxane comprises more than about 50% cyclic siloxane pentamer, more preferably more than about 75% cyclic siloxane pentamer, most preferably at least about 90% of the cyclic siloxane pentamer. Also preferred for use herein are siloxanes that are a mixture of cyclic siloxanes having at least about 90% (preferably at least about 95%) pentamer and less than about 10% (preferably less than about 5%) tetramer and/or hexamer.

The lipophilic fluid can include any fraction of dry-cleaning solvents, especially newer types including fluorinated solvents, or perfluorinated amines. Some perfluorinated amines such as perfluorotributylamines, while unsuitable for use as lipophilic fluid, may be present as one of many possible adjuncts present in the lipophilic fluid-containing composition.

Other suitable lipophilic fluids include, but are not limited to, diol solvent systems e.g., higher diols such as $C_6$ or $C_8$ or higher diols, organosilicone solvents including both cyclic and acyclic types, and the like, and mixtures thereof.

Non-limiting examples of low volatility non-fluorinated organic solvents include for example OLEAN® and other polyol esters, or certain relatively nonvolatile biodegradable mid-chain branched petroleum fractions.

Non-limiting examples of glycol ethers include propylene glycol methyl ether, propylene glycol n-propyl ether, propylene glycol t-butyl ether, propylene glycol n-butyl ether, dipropylene glycol methyl ether, dipropylene glycol n-propyl ether, dipropylene glycol t-butyl ether, dipropylene glycol n-butyl ether, tripropylene glycol methyl ether, tripropylene glycol n-propyl ether, tripropylene glycol t-butyl ether, tripropylene glycol n-butyl ether.

Non-limiting examples of other silicone solvents, in addition to the siloxanes, are well known in the literature, see, for example, Kirk Othmer's Encyclopedia of Chemical Technology, and are available from a number of commercial sources, including GE Silicones, Toshiba Silicone, Bayer, and Dow Corning. For example, one suitable silicone solvent is SF-1528 available from GE Silicones.

Non-limiting examples of glycerine derivative solvents include materials having the following structure:

Non-limiting examples of suitable glycerine derivative solvents for use in the methods and/or apparatuses of the present invention include glyercine derivatives having the following structure:

Structure I

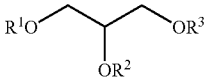

wherein $R^1$, $R^2$ and $R^3$ are each independently selected from: H; branched or linear, substituted or unsubstituted $C_1$-$C_{30}$ alkyl, $C_2$-$C_{30}$ alkenyl, $C_1$-$C_{30}$ alkoxycarbonyl, $C_3$-$C_{30}$ alkyleneoxyalkyl, $C_1$-$C_{30}$ acyloxy, $C_7$-$C_{30}$ alkylenearyl; $C_4$-$C_{30}$ cycloalkyl; $C_6$-$C_{30}$ aryl; and mixtures thereof. Two or more of $R^1$, $R^2$ and $R^3$ together can form a $C_3$-$C_8$ aromatic or non-aromatic, heterocyclic or non-heterocyclic ring.

Non-limiting examples of suitable glycerine derivative solvents include 2,3-bis(1,1-dimethylethoxy)-1-propanol; 2,3-dimethoxy-1 -propanol; 3-methoxy-2-cyclopentoxy-1-propanol; 3-methoxy-1-cyclopentoxy-2-propanol; carbonic acid (2-hydroxy-1-methoxymethyl)ethyl ester methyl ester; glycerol carbonate and mixtures thereof.

Non-limiting examples of other environmentally-friendly solvents include lipophilic fluids that have an ozone formation potential of from about 0 to about 0.31, lipophilic fluids that have a vapor pressure of from about 0 to about 0.1 mm Hg, and/or lipophilic fluids that have a vapor pressure of greater than 0.1 mm Hg, but have an ozone formation potential of from about 0 to about 0.31. Non-limiting examples of such lipophilic fluids that have not previously been described above include carbonate solvents (i.e., methyl carbonates, ethyl carbonates, ethylene carbonates, propylene carbonates, glycerine carbonates) and/or succinate solvents (i.e., dimethyl succinates).

As used herein, "ozone reactivity" is a measure of a VOC's ability to form ozone in the atmosphere. It is measured as grams of ozone formed per gram of volatile organics. A methodology to determine ozone reactivity is discussed further in W. P. L. Carter, "Development of Ozone Reactivity Scales of Volatile Organic Compounds", Journal of the Air & Waste Management Association, Vol. 44, Pages 881-899, 1994. "Vapor Pressure" as used can be measured by techniques defined in Method 310 of the California Air Resources Board. Preferably, the lipophilic fluid comprises more than 50% by weight of the lipophilic fluid of cyclopentasiloxanes, ("D5") and/or linear analogs having approximately similar volatility, and optionally complemented by other silicone solvents.

Optional/Adjunct Ingredients

While not essential for the purposes of the present invention, the non-limiting list of optional ingredient illustrated hereinafter are suitable for use in the instant cleaning compositions and may be desirably incorporated in certain embodiments of the invention, for example to assist or enhance cleaning performance, for treatment of the substrate to be cleaned, or to modify the aesthetics of the cleaning composition as is the case with additional perfumes, colorants, dyes or the like. The precise nature of these additional components, and levels of incorporation thereof, will depend on the composition and the nature of the cleaning operation for which it is to be used. Suitable adjunct materials include, but are not limited to, additional surfactants, builders, dye transfer inhibiting agents, dispersants, enzymes, and enzyme stabilizers, catalytic metal complexes, polymeric dispersing agents, clay soil removal/anti-redeposition agents, brighteners, suds suppressors, dyes, perfumes, structure elasticizing agents, fabric softeners, carriers, hydrotropes, processing aids and/or pigments. Examples of optional/adjunct ingredients and levels of use are found in U.S. Pat. Nos. 5,576,282, 6,306,812 B1 and 6,326,348 B1 that are incorporated by reference.

Test Method

Odor Intensity Index Method

By Odor Intensity Index, it meant that the pure chemicals were diluted at 1% in Dipropylene Glycol, odor-free solvent used in perfumery. This percentage is more representative of usage levels. Smelling strips, or so called "blotters", were dipped and presented to the expert panellist for evaluation. Expert panellists are assessors trained for at least six months in odor grading and whose gradings are checked for accuracy and reproducibility versus a reference on an on-going basis. For each amine compound, the panellist was presented two blotters: one reference (Me Anthranilate, unknown from the panellist) and the sample. The panellist was asked to rank both smelling strips on the 0-5 odor intensity scale, 0 being no odor detected, 5 being very strong odor present.

Results:

The following represents the Odor Intensity Index of an amine compound suitable for use in the present invention and according to the above procedure. In each case, numbers are arithmetic averages among 5 expert panellists and the results are statistically significantly different at 95% confidence level:

| | |
|---|---|
| Methylanthranilate 1% (reference) | 3.4 |
| Ethyl-4-aminobenzoate (EAB) 1% | 0.9 |

EXAMPLES

Example 1

A Starch Encapsulated Accord is Made as Follows 1. 225 g of CAPSUL modified starch (National Starch & Chemical) is added to 450 g of water at 24° C.
2. The mixture is agitated at 600 RPM (turbine impeller 2 inches in diameter) for 20 minutes.
3. 75 g perfume oil is added near the vortex of the starch solution.
4. The emulsion formed is agitated for an additional 20 minutes (at 600 RPM).
5. Upon achieving a perfume droplet size of less than 15 microns, the emulsion is pumped to a spray drying tower and atomized through a spinning disk with co-current airflow for drying. The inlet air temperature is set at 205-210° C., the exit air temperature is stabilized at 98-103° C.
6. Dried particles of the starch encapsulated perfume oil are collected at the dryer outlet.

Example 2

A Perfume Containing, Coated Zeolite is made as Follows

1. Preparation of fragrance loaded zeolite 10 gr of activated zeolite Na—X (<5% residual moisture) is placed in a simple mixer or coffee grinder type of mixing device. To that 1.5 gr of perfume is added in a drop-wise fashion. The mixture is agitated for about 10 min. resulting in a PLZ (Perfume Loaded Zeolite) with a 15% w/w loading.
2. Preparation of low moisture hydrogenated starch hydrolysates (Tg=120° C.). 100 g of hydrogenated starch hydrolysate such as POLYSORB RA-1000 from Roquette America (75% solids) is heated under continuous agitation until enough water is removed to obtain a low moisture syrup containing less than 5% water. Under atmospheric pressure such low water levels lead to boiling points of the viscous syrup in the range
3. Combination of PLZ and low moisture syrup. PLZ is added to the hot low moisture syrup. Typically a level of 20-40% by weight PLZ is added. For efficient mixing, high energy input (such as the use of a high-torque mixer or extruder) is preferred.
4. Glass particle formation/size reduction. The PLZ dispersion in the low moisture syrup is allowed to cool to ambient temperature. As the temperature of the system falls below the glass transition temperature of the syrup, a glassy system is obtained which can be ground and sized to various particle sizes. Alternatively, the system in its rubbery or malleable state can be prilled or pelletized to form particles of desired size and shape.

Example 3

An Amine Reaction Product is Made as Follows

An amine reaction product is prepared from Lupasol G100 (commercially available by BASF content 50% water, 50% Lupasol G100 (Mw. 5000)) and Damascone is prepared as follows: Commercially available Lupasol G100 is dried using the following procedure: 20 g of the Lupasol solution is dried at the rotating evaporator during several hours. The residue, was azeotropically distilled at the rotating evaporator using toluene. The residue was then placed in the dessiccator dried at 60° C. The dried sample is then used in the preparation of the reaction product. 1.38 g of the dried Lupasol G100 is dissolved in 7 ml of ethanol. The solution is stirred gently with a magnetic stirrer for a few minutes before 2 g $Na_2SO_4$ (anhydrous) is added. After stirring for a few minutes 2.21 g Damascone is added over a period of 1 minute. After two days reaction time, the mixture is filtrated over a Celite filter, and the residue is washed thoroughly with ethanol. About 180 ml. of light foaming filtrate is obtained. This is concentrated until dryness using a rotating evaporator and dried over dessicant, in a dessiccator at room temperature. About 3.5 g of a colorless oil reaction product was obtained.

Example 4

Preparation of Lipophilic Cleaning Fluid Composition

A lipophilic cleaning fluid composition in accordance with the present invention can be made as follows:

Step 1—0.01% by weight of an amine in accordance with the present invention is added to a lipophilic fluid and the composition is then mixed for about 1-3 minutes;

Step 2—0.015% by weight of a benefit agent in accordance with the present invention is added to the amine-containing lipophilic fluid composition from Step 2 and the composition is then mixed for about 5 minutes.

*Note that Step 2 and Step 3 are separate discrete addition steps.

Example 5

Microparticles are Made as Follows

| | |
|---|---|
| 1080 g | of water |
| 160 g | of a 10% solution of a 88% hydrolysed poly vinyl acetate (viscosity of a 4% aqueous solution: 40 mPas) called "poly vinyl alcohol" |
| 510 g | of methyl methacrylate |
| 60 g | of butanediol diacrylate |
| 30 g | of dimethylaminoethyl methacrylate |
| 3.8 g | of t-butyl perpivalate |

Feedstream 1: 1.08 g of t-butyl hydroperoxide, 70% strength in water

Feedstream 2: 0.38 g of ascorbic acid, 14 g of water

The above substances were initially introduced at room temperature with exception of the perpivalate and was adjusted to a pH of 6 with 10% strength hydrochloric acid. The water and monomer phase were dispersed using a high-speed dissolver stirrer at 2500. After 40 minutes of dispersing a stable emulsion with a particle size of from 2 to 12.mu.m (diameter) was obtained. The t-butyl perpivalate was added and the emulsion was heated to 72.degree.C., while stirring with an anchor stirrer, then heated to 85.degree.C. over the course of a further 120 minutes, and holding at 85.degree.C. over the course of a further 60. The resulting microparticle dispersion was cooled with stirring to 70.degree.C., and feedstream 1 was added. Feedstream 2 was metered in with stirring over 80 minutes at 70.degree.C. The composition was then cooled, and the resulting microparticle dispersion had a solids content of 31.2% and an particle size comparable to the particle size of the emulsion prior to polymerization.

Example 6

Nanolatex

In a 30 liter pressure-vessel with stirrer was placed a mixture of 5 Kg methylmethacrylate, 263 g dimethylaminoethylmethacrylate, 14 g butanediol-di acrylate, 175 g hydrochloric acid (37%) and 53 g of 2,2'-azobis(2-amidinopropane)dihydrochloride and 12.1 Kg water. The mixture was heated up to 85° C. for 1 hours, followed by cooling down to 75° C. and stirring for another 6 h at a stir rate of 100 rpm resulting in an aqueous dispersion with a solid content of 30% and a pH of 3.

Example 7

Microcapsules

A urea-formaldehyde precondensate is first formed by heating a mixture of 162 g 37% aqueous formaldehyde and 60-65 g urea, adjusted to pH 8.0 with 0.53 g sodium tetraborate, for 1 hour at 70° C., and then adding 276.85 g water. 429.ml of this precondensate and 142 ml water are then stirred in a 1-l steel reactor and 57.14 g sodium chloride and 0.57 g sodium carboxymethyl cellulose added. Then are added the core components comprising 161.3 g POLYWAX 500 carrier and 60.7 ml perfume, and the reactor is heated to about 10° C. above the core melting point. Agitation is adjusted to emulsify and maintain the molten core at the desired drop size, and the pH of the contents is adjusted to about 5.0 with dilute hydrochloric acid. The reactor is then allowed to cool to room temperature with a gradual pH reduction to 2.2 over a 2 hour period. The reactor is then increased to about 50° C. for a further 2 hours, then cooled to room temperature, after which the pH is adjusted to 7.0 with 10% sodium hydroxide solution.

What is claimed is:

1. A fabric care and cleaning composition comprising:

a.) a lipophilic fluid comprising more than about 50% decamethylcylcopentasiloxane; and b.) from about 0.001% to about 10%, by weight of the total cleaning composition, of a perfume delivery system which comprises an amine reaction product comprising a perfume aldehyde or perfume ketone and an organosiloxane having at least one primary amine moiety.

2. A composition according to claim 1, further containing an adjunct ingredient selected from the group consisting of: surfactants, builders, dye transfer inhibiting agents, dispersants, enzymes, and enzyme stabilizers, catalytic metal complexes, polymeric dispersing agents, clay soil removal/anti-redeposition agents, brighteners, suds suppressors, dyes, perfumes, structure elasticizing agents, fabric softeners, carriers, hydrotropes, processing aids and/or pigments.

* * * * *